US005648626A

United States Patent [19]

Okamoto

[11] Patent Number: 5,648,626

[45] Date of Patent: Jul. 15, 1997

[54] MUSICAL TONE CONTROLLER RESPONSIVE TO PLAYING ACTION OF A PERFORMER

[75] Inventor: Tetsuo Okamoto, Hamamatsu, Japan

[73] Assignee: Yamaha Corporation, Japan

[21] Appl. No.: 33,022

[22] Filed: Mar. 18, 1993

[30] Foreign Application Priority Data

Mar. 24, 1992 [JP] Japan ..... 4-065944

[51] Int. Cl.[6] ..... G10H 7/00

[52] U.S. Cl. ..... 84/600; 84/658; 84/670

[58] Field of Search ..... 84/600, 644, 647, 84/670, 658, 659

[56] References Cited

U.S. PATENT DOCUMENTS

| | | | |
|---|---|---|---|
| 4,962,688 | 10/1990 | Suzuki et al. | 84/600 |
| 4,998,457 | 3/1991 | Suzuki et al. | 84/600 |
| 5,105,708 | 4/1992 | Suzuki et al. | 84/600 |
| 5,177,311 | 1/1993 | Suzuki et al. . | |
| 5,290,966 | 3/1994 | Aoki | 84/626 |
| 5,313,010 | 5/1994 | Matsushima et al. | 84/600 |
| 5,338,891 | 8/1994 | Masubuchi et al. | 84/600 |

FOREIGN PATENT DOCUMENTS

| | | |
|---|---|---|
| 63-252179 | 10/1988 | Japan . |
| 3-7992 | 1/1991 | Japan . |

*Primary Examiner*—Jonathan Wysocki
*Assistant Examiner*—Jeffrey W. Donels
*Attorney, Agent, or Firm*—Graham & James LLP

[57] ABSTRACT

A musical tone controlling apparatus includes a tone generation instruction device, a detection device, tonal parameter generation device and a tone signal forming device. The tone generation instruction device outputs a tone generation start signal in accordance with a playing action of a performer. The detection device detects a movement or a state of the performer's body and generates a detection signal in accordance with the detected result. The tonal parameter generation device generates a first tonal parameter in accordance with the detection signal when the tone generation start signal is received and generates a second tonal parameter in accordance with the detection signal after the tone generation start signal has been received. The tone signal forming device controls the tone signal formation of a musical tone to be generated in accordance with the first tonal parameter and the second tonal parameter.

7 Claims, 11 Drawing Sheets

NOTE NAME

| RIGHT \ LEFT | 1 | 2 | 3 |
|---|---|---|---|
| 1 | C | E | G |
| 2 | D | F | A |
| 3 | E | G | B |

MUSICAL TONE CONTROLLER RESPONSIVE TO PLAYING ACTION OF A PERFORMER

BACKGROUND OF THE INVENTION

This invention relates to an apparatus which controls musical tone generation in accordance with a play action (movement or present state) of a body Joint, for example, an elbow or a wrist.

TECHNICAL BACKGROUND OF THE INVENTION

There are known technologies for controlling musical tone generation in accordance with the signals outputted from sensors which detect movements of the body Joints or finger pressures. Some examples of such control apparatus are disclosed in Japanese Patent, Laid-open No. Sho 63-252179 and Japanese Patent, Laid-open No. Hei 3-7992.

First, the Japanese Patent, Laid-open No. Sho 63-252179 discloses a musical sound control apparatus which controls the tone pitch of a musical sound in accordance with the raising angle of an arm. This apparatus, shown in FIG. 12, comprises a stick S which generates a key-on signal by the operation of a push button switch 11, and an angle detector 12 which is disposed on a shoulder joint section to detect the raising angle of an arm. The tone pitch of a musical tone to be generated is controlled in accordance with the signal being outputted from the angle detector 12 when the push button switch 11 is operated.

On the other hand, the Japanese Patent, Laid-open No. Hei 3-7992 discloses a musical sound control apparatus which controls the scale note of a musical to be generated in accordance with the bend angles of the left and right elbows. This apparatus, as shown in FIG. 13, comprises angle detectors 1L, 1R for the left and right elbows, grip type switches 2L, 2R to be held in left and right hands and connectors 3L, 3R. Each of the angle detectors 1L, 1R comprises optical fiber F which alters the light transmission in accordance with the degree of the bend angle of an elbow, and detection device, having a light emitting element D1 and a light sensor D2, which detects the variation in the light intensity and outputs signals corresponding to the degree of the bend angle. The grip type switches 2L, 2R comprise pressure sensors SL1 to SL7 and SR1 to SR7 which generate signals corresponding to the pressures of the fingers.

The connectors 3L, 3R are connected with tone control sections (not shown). The control section determines the bend angles of the left and right elbows based on the signals outputted by the angle detectors 1L, 1R, and controls the scale of the musical tone to be generated in accordance with the determined bend angles. The tone control section also controls control-parameters of the musical tone such as key-on and key-off events, tone color and tone volume in accordance with the signals outputted by the various pressure sensors SL1 to SL7 and SR1 to SR7 in the grip type switches 2L, 2R.

In the apparatuses described above, the signals from the angle detectors are used only at the start timing of a tone generation process such as the key-on so as to control the tone pitch of the musical tone but are not used to control the tone generation during the sustaining period of the tone generation process.

Therefore, the conventional musical tone control apparatuses have a problem that even if the performer makes playing actions, during the tone generation process., once the tone has been generated, the character of the sustaining tone could not be changed on the way of the tone generation process.

SUMMARY OF THE INVENTION

The present invention was developed in consideration of the state of the art as described above, and the purpose is to present a musical tone control apparatus capable of controlling the sustaining tone even during the tone generation in accordance with the movement of the performer.

The present invention presents a musical tone controlling apparatus comprising:

(a) tone generation instruction device for outputting a tone generation start signal in accordance with a playing action of a performer;

(b) detection device for detecting a movement or a state of the performer's body, and generating a detection signal in accordance with the detected result;

(c) tonal parameter generation device for generating a first tonal parameter in accordance with the detection signal when the tone generation start signal is received and for generating second tonal parameter in accordance with the detection signal after the tone generation start signal has been received; and (d) tone signal forming device for controlling the tone signal formation of a musical tone to be generated in accordance with the first tonal parameter and the second tonal parameter.

According to the configuration of the apparatus as presented above, the tone generation instruction device outputs tone generation start signal in accordance with the playing actions of a performer and the detection device detects the body movement of the performer, and outputs detected signal in accordance with the detection results. The tonal parameter generation device generates a first tonal parameter (for example, tone pitch), in accordance with the detected signal, when a tone generation start signal is received; and after the tone generation start signal is received, the tonal parameter generation device generates a second tonal parameter (for example, tone volume) in accordance with the detected signal. The tone signal forming device generates a tone in accordance with the first tonal parameter and the second tonal parameter. By so doing, the apparatus enables tone control operations not only at the start of the tone generation process but also during the generation process in accordance with the playing actions of the performer.

As summarized above, according to the present invention, it is possible to provide complex tonal effects to a sound being generated by body motions or body states.

BRIEF EXPLANATION OF THE DRAWINGS

FIG. 6 shows three bases for processing for an elbow after the start of tone generation, corresponding to the three elbow bending conditions at the start of the tone generation process.

PREFERRED EMBODIMENTS OF THE INVENTION

An embodiment of the present invention will be explained in the following with reference to the drawings.

Figure 1:
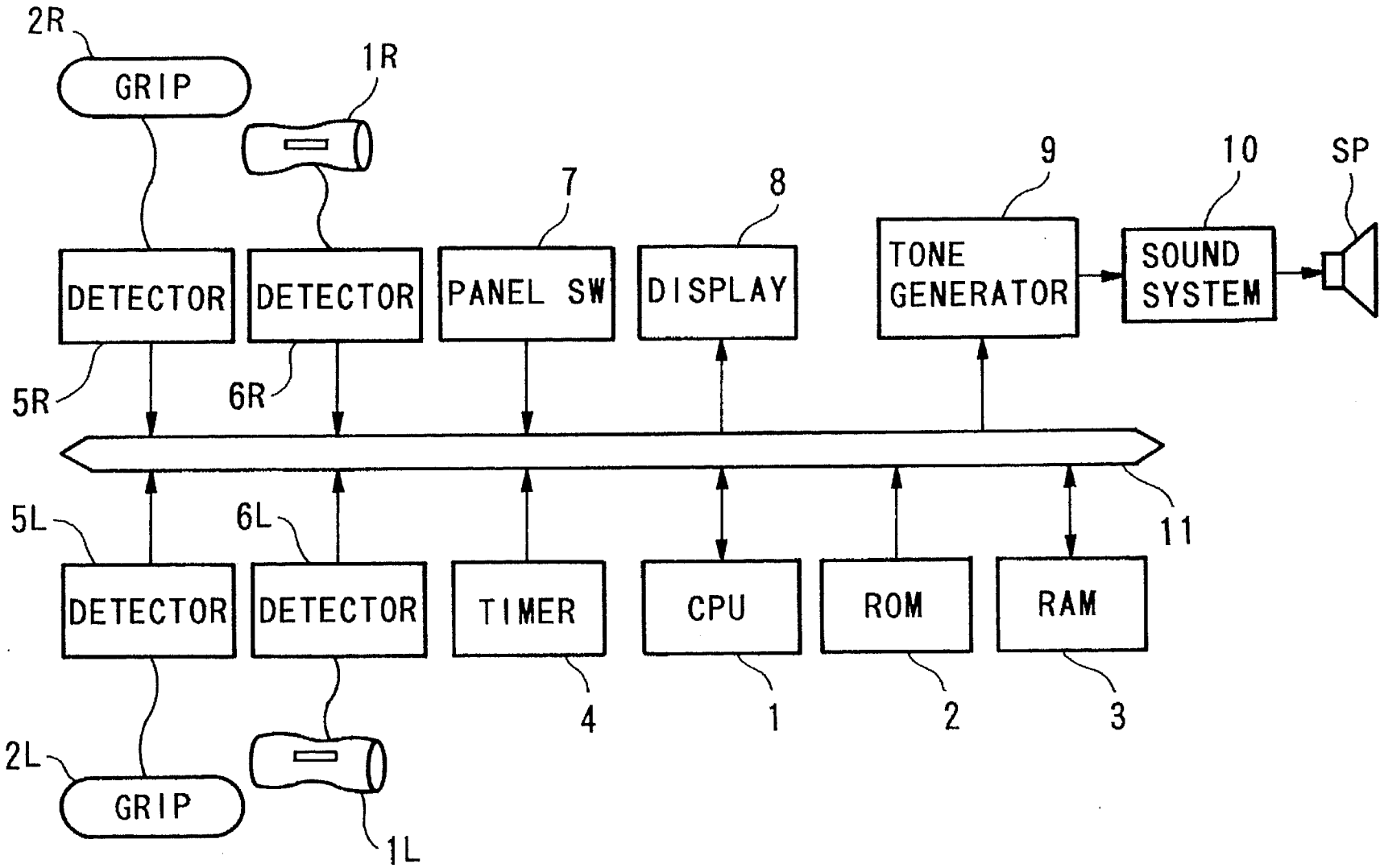
FIG. 1 is a block diagram for the configuration of a musical tone controlling apparatus in an embodiment of the present invention.

FIG. 1 is a block diagram showing the component configuration in an embodiment of a tone control apparatus. The reference numeral 1 designates a central processing unit (CPU) 1 for controlling the various sections of the apparatus connected to the bus 11. The operation of CPU1 will be explained in detail later. The numeral 2 is a read only memory (ROM) 2 for storing the various programs for controlling the various sections of the apparatus; 3 is a random access memory (RAM) 3 for storing the values of the registers and such, and is a work area for the CPU1; 4 is a timer for generating the clock pulses for the CPU1. The CPU1 monitors the clock pulse count, and performs the elbow processing and grip processing when the clock pulse count reaches certain specified values.

Figure 3:
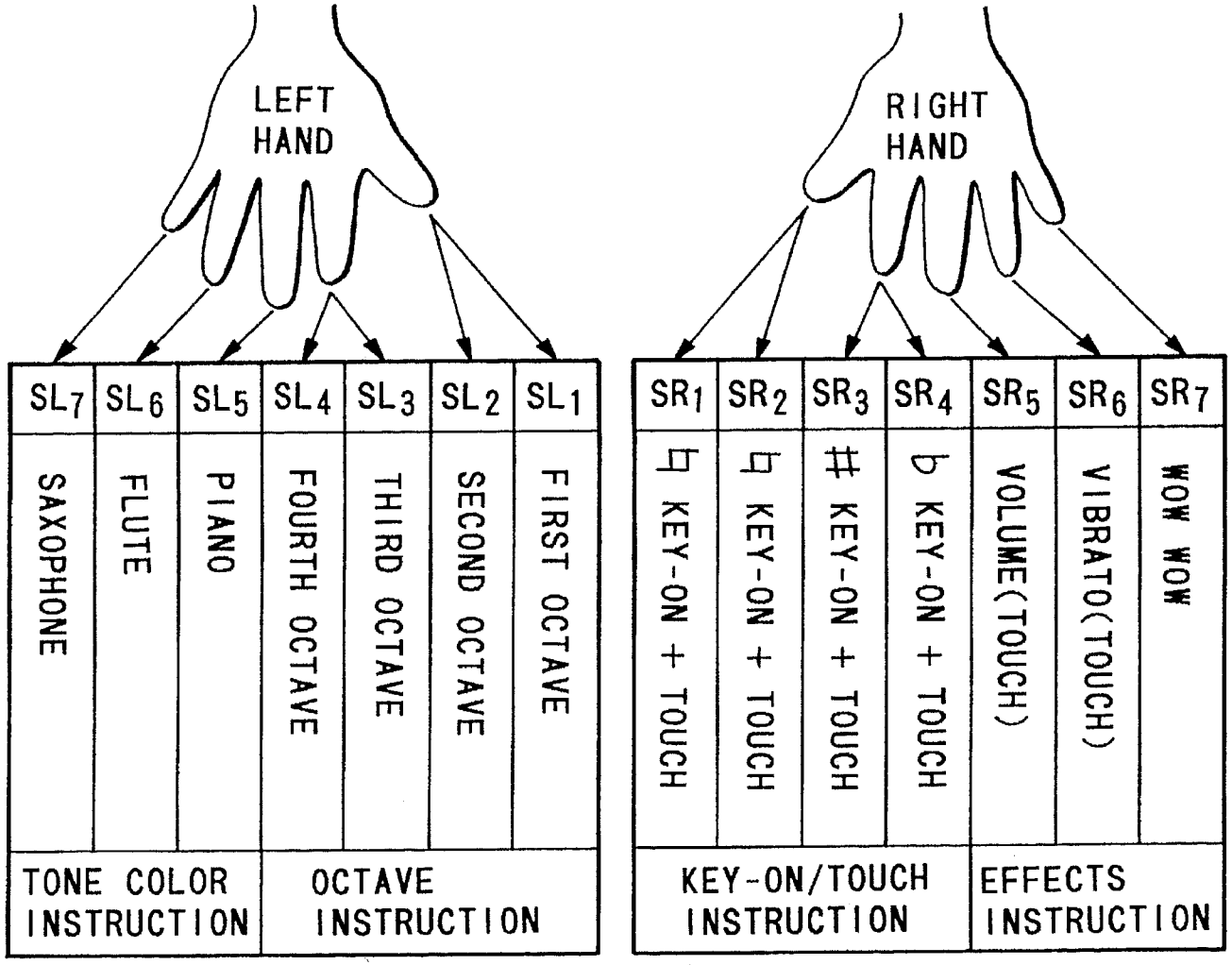
FIG. 3 shows the various function assignments given to each of the sensors SR1 to SR7 and SL1 to SL7 in the left and right grip type switches 2L, 2R.
Figure 13:
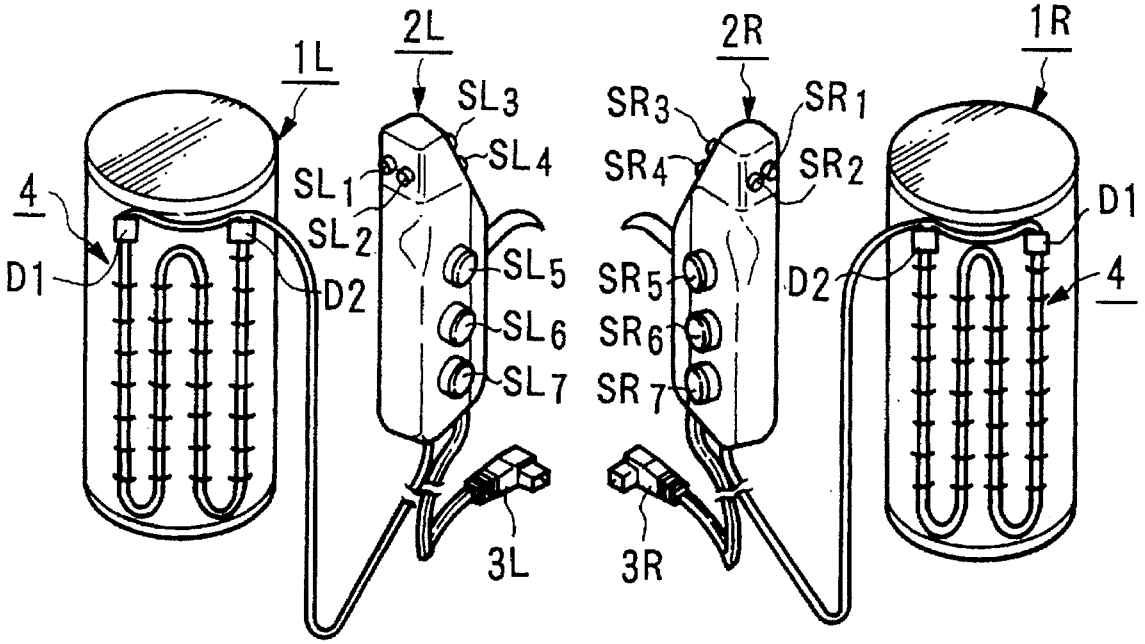
FIG. 13 is an arrangement of an example of the conventional control apparatus for controlling the tone scale in accordance with the degree of bend of the left and right elbows.

The reference numerals 5R, 5L refer to detectors which convert the analogue signals from the grip type switches 2R, 2L shown in FIG. 13 to digitized pressure data and output the pressure data. In other words, each of the grip type switches 2R, 2L includes pressure sensors SR1 to SR7, SL1 to SL7, and outputs detected grip signals at various levels in accordance with the degree of grip pressing actions. The detectors 5R, 5L transform the analogue grip signals into digitized pressure data, and output the pressure data to the bus 11. Each of the pressure sensor groups, SR1 to SR7, and SL1 to SL7 of the grip type switches 2R, 2L is provided with assigned functions as shown in FIG. 3.

The functional assignments of each of the pressure sensors SR1 to SR7 and SL1 to SL7 will be explained with reference to FIG. 3. First, when the pressure sensors SR1 to SR7 disposed in the right hand grip type switch 2R are operated, the key-on pressures and touch pressures are specified in accordance with the generated pressure data. However, when the key-on event is specified by the pressure sensor SR3, the tone generated is a semitone higher (a sharp tone instruction), and when the key-on event is specified by the pressure sensor SR4, it is a semi tone lower (a flat tone instruction). On the other hand, when the key-on event is specified by SR1 or SR2, the instruction of the derivative tones, sharp and flat tones, reverts to the natural tone instruction. When the pressure sensors SR5 to SR7 are pressed, the tone effects are specified, such as the volume levels, vibrato levels and the presence or absence of WowWow, in accordance with the pressure data.

On the other hand, when the pressure sensors SL1 to SL4 disposed in the left grip type switch 2L are operated, the first octave to the fourth octave are specified in accordance with the pressure data, and when the pressure sensors SL5 to SL7 are operated, various tone colors are specified, such as piano, flute and saxophone, in accordance with the pressure data.

Returning to FIG. 1, the component configuration of the embodiment will now be explained. In FIG. 1, the reference numerals 6R, 6L are detectors, which receive the analogue signals supplied by the angle detectors 1R, 1L (referred to as elbow sensors) shown in FIG. 13, and output digitized data. In other words, the elbow sensors 1R, 1L output signals varying in levels in accordance with the degree of elbow bending, and output the data. The detectors 6R, 6L transform this signal to detection data corresponding to the degree of bending, and output the data to the bus 11.

Further, the degree of bending of the elbow sensors 1R, 1L which existed at the start of the tone generation process, is expressed by a state number classified in three states. That is, as shown in FIG. 4, state 1 refers to the range of angles $\theta_1$ measured from a totally stretched out elbow; state 2 refers to the range of angles from $\theta_1$ to $\theta_2$; and state 3 refers to the range of angles from $\theta_2$ to the maximally bent elbow.

Figures 4, 5:
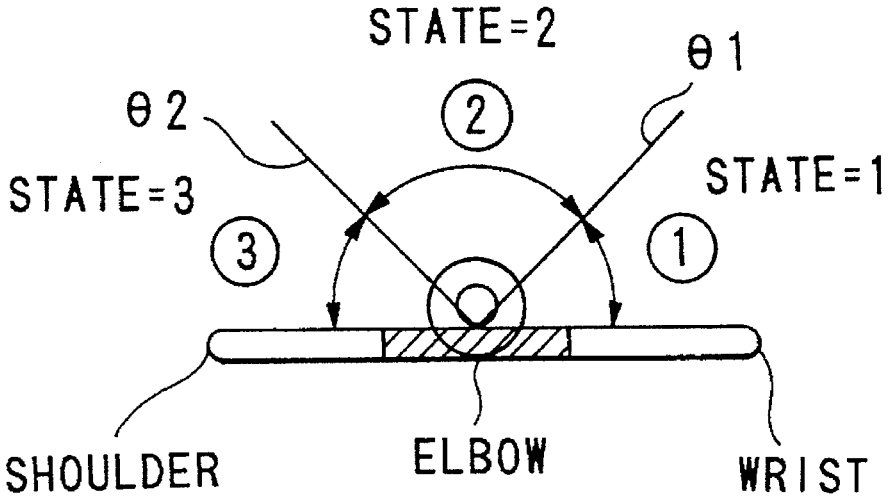
FIG. 4 shows the various state assignments given to the bend angles of an elbow in three states 1 to 3.
FIG. 5 shows the note name assignments for the various combinations of the states 1 to 3 for the bend angles of an elbow.

And as shown in FIG. 5, the various combinations of the states 1 to 3 for both left and right elbows define the various note names "C" to "B", thereby specifying the tones at the start of the tone generation process. For example, when the right elbow bending angle is state 3 and the left elbow bending angle is state 2, the tone specified at the start of the tone generation process is a "G".

Returning to FIG. 1 again, the component configuration of the embodiment will be explained. In FIG. 1, the numeral 7 refers to a panel switch group including such switches as tone color switches, and generate signals corresponding to the switch settings. The numeral 8 refer to display devices including LCD panels, displaying the various settings made by the panel switch group 7. The numeral 9 refers to a traditional tone generator constituted by the waveform memories readout system, and generates a tone signal based on the tone control data supplied from the CPU1. The numeral 10 refers to a sound system which performs tone effects processing on the signal supplied from the tone generator 9, and amplifies the signal to be outputted from the speakers SP.

Figure 2:
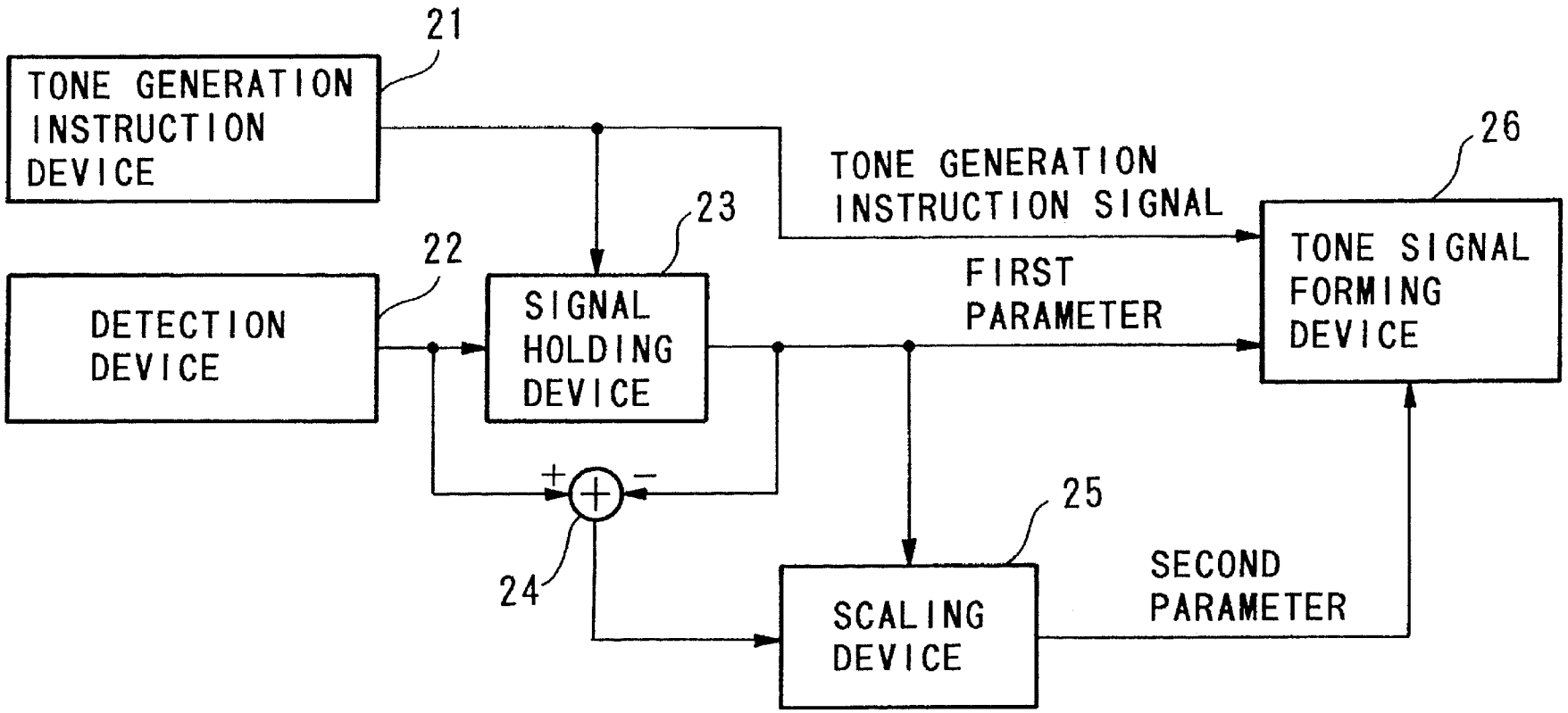
FIG. 2 is a block diagram showing the elements of the various functions of the apparatus.

At this point, the functional capabilities of the embodiment having the configurations presented above will be explained with reference to the functional block diagram shown in FIG. 2. In this figure, tone generation instruction device 21 (corresponds to grip type switch 2R) generates a tone generation start signal to begin a tone generation process; and the detection device 22 (corresponds to elbow sensors 1R, 1L) detect the degree of bending of the left and right elbows, and output corresponding detected signals.

The signal holding device 23 (corresponds to a function of the CPU1) holds the detected signal outputted by the detection device 22 as the tone generation instruction signal is being received, then outputs it as a first tonal parameter to the tone signal forming device 26. The tone signal forming device 26 (corresponds to the tone generator 9) generates a sound of a tone pitch, in accordance with the first tonal parameter, immediately upon receiving the tone generation instruction signal.

A decrementing device 24 (a function of the CPU1) decrements the detected signal, successively outputted from the detection device 22, by the signal corresponding to the first tonal parameter, and outputs the result to a scaling device 25. The scaling device 25 (a function of CPU1) performs scaling processing (to be explained later) on the output data of the decrementing device 24 in accordance with the signal corresponding to the first tonal parameter, and outputs the result as a second tonal parameter. The tone signal forming device 26 controls the tone being generated in accordance with the second tonal parameter.

According to such a functional configuration, when the tone generation instruction device 21 produces a tone generation start signal, the output signal from the detection device 22 is held in the signal holding device 23, and a tone having a tone pitch in accordance with the first tonal parameter. The tone thus generated is characterized further by the second tonal parameter generated by the decrementing device 24 and the scaling device 25.

The operation of the apparatus of the above described configuration will be explained with reference to the flow charts shown FIGS. 7 to 10. The explanation is provided in chronological sequence in accordance with the actual operational sequence of the apparatus.

(A) Pre Key-on Event Operations

Figure 7:
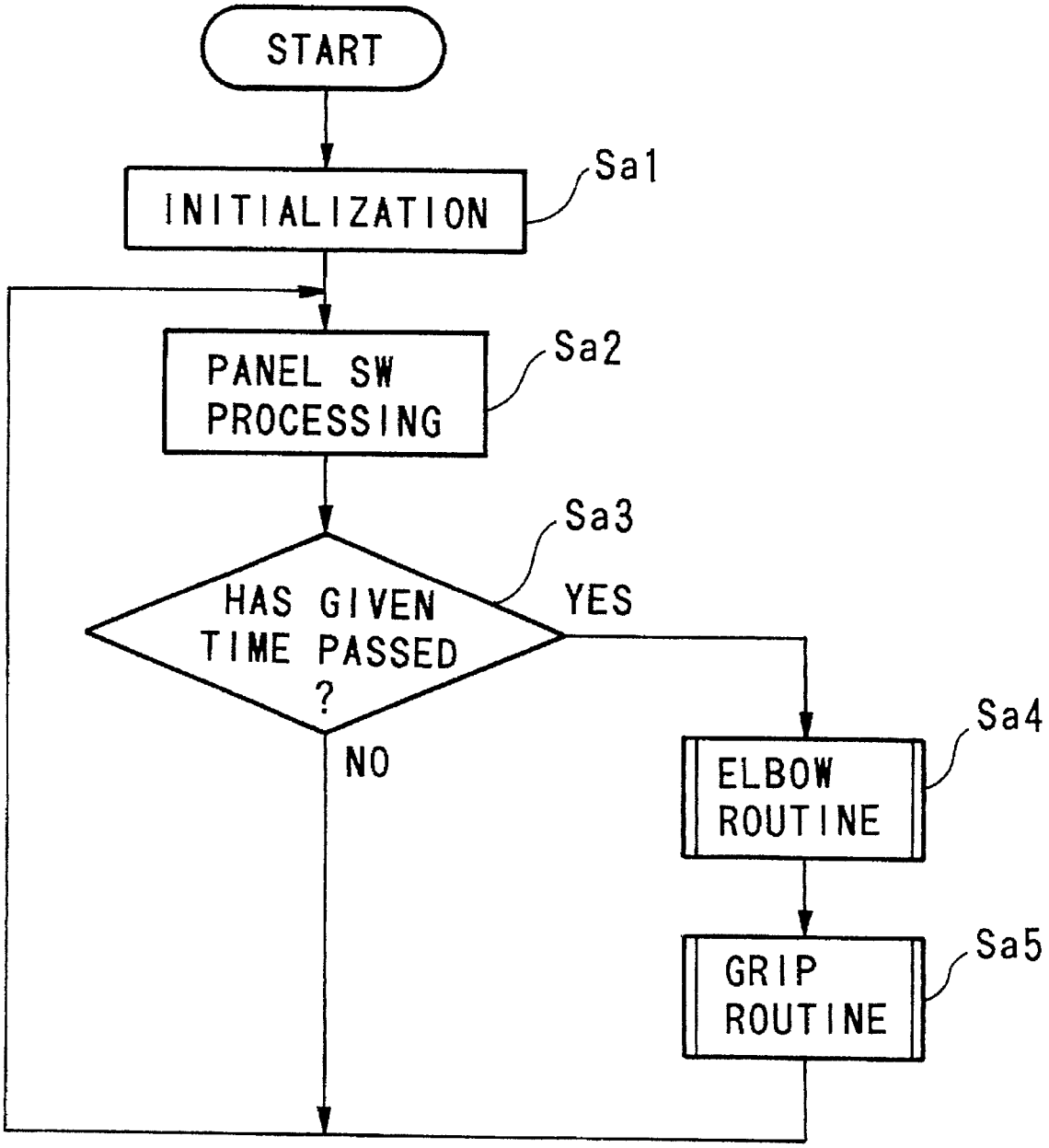
FIG. 7 is a flow chart showing the steps in the main routine in the control program for the central processing unit (CPU) 1.

First, when the power to the apparatus is turned on, the CPU1 (hereinbelow referred to as "it") loads the control programs stored in ROM 2. The main routine shown in FIG. 7 is started up, and it proceeds to step Sa1, in which initialization operation is performed by setting initial values into the various registers, and it proceeds to step Sa2. In step Sa2, it scans the switch group 7, and sets the registers to correspond with the switch settings, and it proceeds to step Sa3.

In step Sa3, it checks whether the clock count supplied by the timer 4 has reached a certain count, i.e. whether a certain time period has elapsed. If the count has not been reached, it goes to [NO], and it returns to step Sa2, and repeats the above step.

If on the other hand, when the count has been reached, in other words, when the decision in step Sa3 becomes [YES] at regular intervals, it proceeds to step Sa4. In step Sa4, it calls up the elbow routine shown in FIG. 8.

Figure 8:
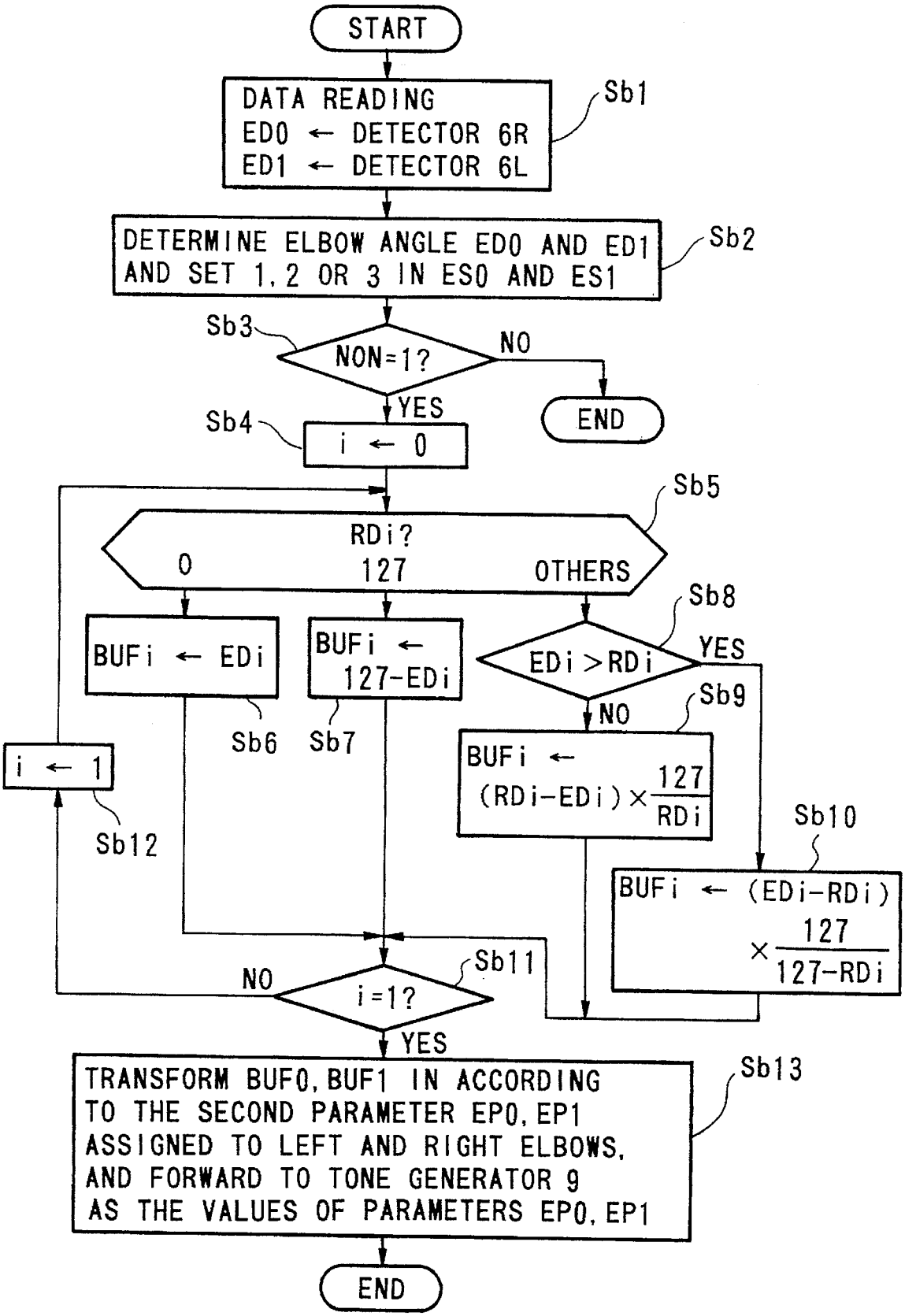
FIG. 8 is a flow chart showing the steps in the elbow routine in the control program for CPU1.

When the elbow routine is started up, it proceeds to step Sb1 (refer to FIG. 8). In step Sb1, it reads the output data from the detector 6R based on the signal from the elbow sensor 1R providing the right elbow bending angle, and inputs the value into the register ED0. It repeats the same for the left elbow, by reading the data from the detector 6L, and loads the data in the register ED1. Accordingly, the register ED0 stores the data on the right elbow bending angle, and the register ED1 stores the data on the left elbow bending angle. It then proceeds to step Sb2.

In step Sb2, it checks the state category of the values in the registers ED0, ED1 to determine which of the three elbow bending states 1, 2 and 3 shown earlier in FIG. 4 is being stored therein. It then inputs the state number, representing the state of elbow bending, into the respective registers ES0, ES1. That is, for example, if the right elbow bending angle is in state 1, it sets state number [1] in the register ES0 and if the left elbow bending angle is in state 3, it sets state number [3] in the register ES1. It then proceeds to step Sb3.

In step Sb3, it checks whether the value of the register NON is [1], i.e. a tone is being generated. In the register NON, a key-on event is indicated by setting [1] and the key-off event by setting [0] in a note-on flag. In the case (A), the register NON is initialized as [0] in step Sa1 (refer to FIG. 7), so the decision is [NO]. The result is that it completes the elbow routine to return to the main routine shown in FIG. 7. In the main routine, it proceeds to step Sa5, and it calls up the grip routine, shown in FIGS. 9 and 10.

Figure 9:
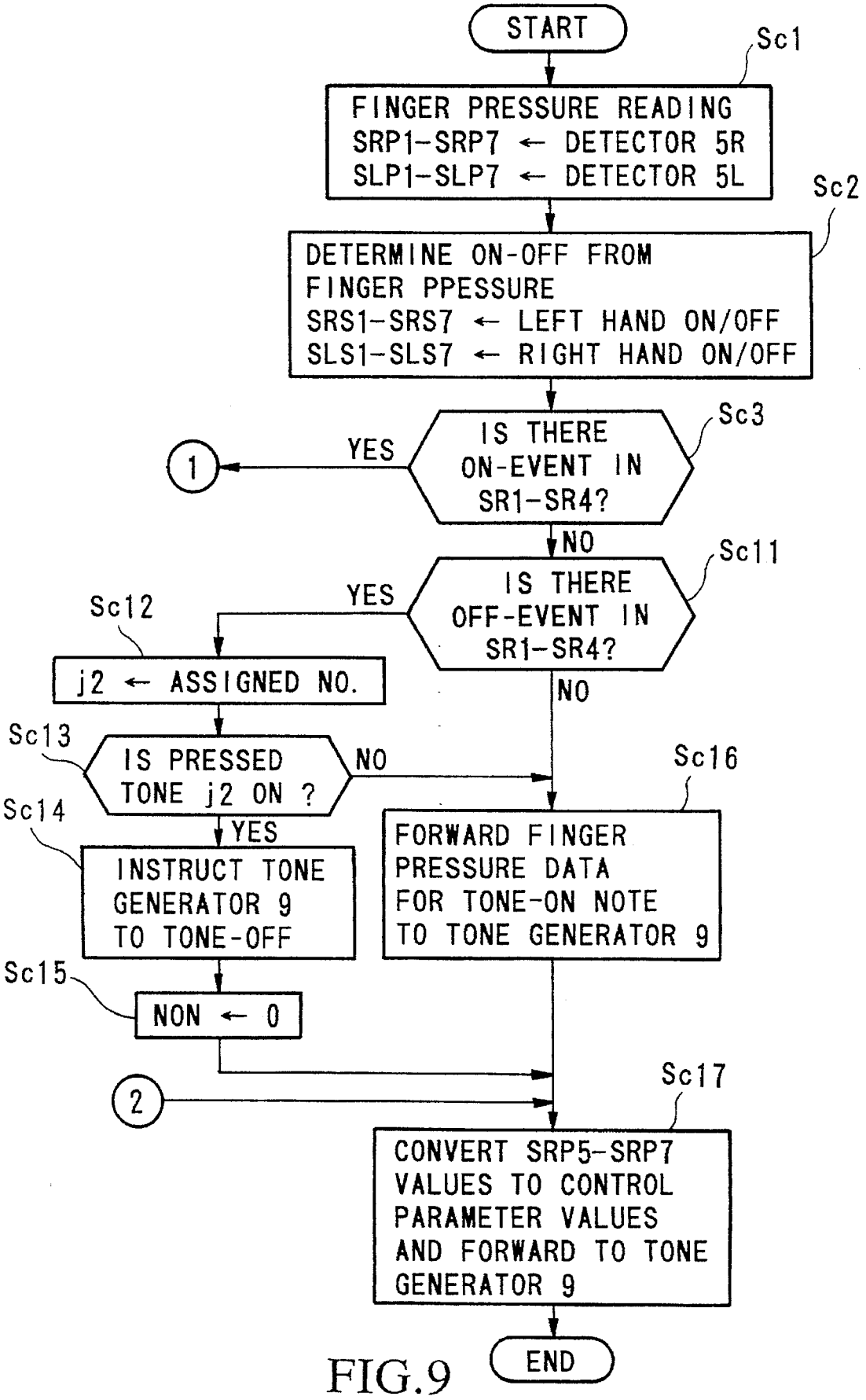
FIGS. 9 and 10 are flow charts showing the steps in the grip routine in the control program for the CPU1.
Figure 10:
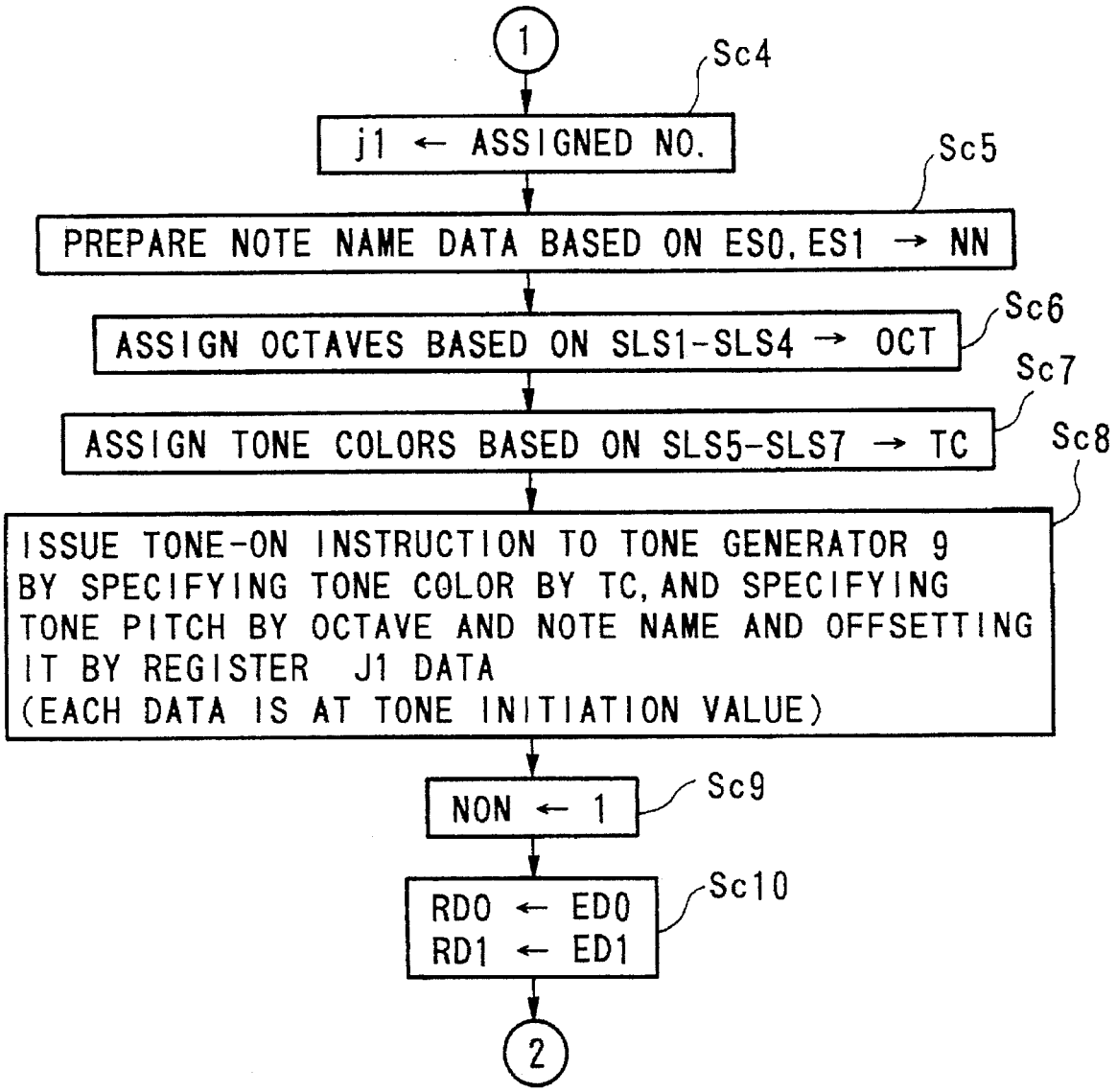

In the grip routine, it first proceeds to step Sc1 shown in FIGS. 9. In step Sc1, it reads in the pressure data from the detector 5R produced by the pressure sensors SR1 to SR7 from the pressing actions of the right grip 2R, and sets the values in the respective registers SRP1 to SRP7. Similarly, it reads in the pressure data from the detector 5L produced by the pressing actions of the pressure sensors SL1 to SL7 of the left grip 2L, and sets the values in the respective registers SLP1 to SLP7.

Next, it proceeds to step Sc2, and it checks whether the values in the registers SRP1 to SRP7 and SLP1 to SLP7 are larger than certain specified values, i.e. whether any of the pressure sensors SR1 to SR4 in the grips 2R, 2L, those sensors which are provided with the key-on/off function, are in the "ON" status or "OFF" status. Having determined the status, it sets the appropriate status values in the respective registers, SRS 1 to SRS 7, and in SLS1 to SLS7. In this case, the "ON" status is indicated by [1] and the "OFF" status is indicated by [0], and it then proceeds to step Sc3 shown in FIG. 10.

In step Sc3, it checks whether a new key-on event has taken place, i.e. whether any of the pressure sensors SR1 to SR4 which are provided with the Key-on/off function have changed to "ON". Here, if any one of the values of the registers SRS1 to SRS4 corresponding to the pressure sensors SR1 to SR4 has changed from [0] to [1], the decision is [YES], and it proceeds to step Sc4, shown in FIG. 10.

(B) Operations at the time of Key-on Event Generation

In step Sc4, the assigned number for the pressure sensor which produced a key-on event is set in the register j1. This assigned number is for the purpose of identifying the pressure sensors SR1 to SR4, and consists of numbers from [1] to [4]. At the start of the tone generation process, the derivative tones, such as sharp and flat notes, are specified on the basis of these assigned numbers, and it then proceeds to step Sc5. In step Sc5, it generates corresponding note name data NN (refer to FIG. 5) in accordance with the values in the registers ES0, ES1 which have been determined already in step Sb2 (FIG. 8) in the elbow routine, and it proceeds to step Sc6.

In step Sc6, it generates octave data OCT on the basis of the values in the registers SLS1 to SLS4. Proceeding onto step Sc7, it generates tone color instruction data TC on the basis of the values in the registers SLS 5 to SLS7, and proceeds on to step Sc 8.

In step Sc8, it specifies the tone pitch of the tone to be generated, on the basis of the values of the note name data NN, octave data OCT and the register j1, and generates tone pitch data TH. That is, the tone pitch data is represented by the note name data NN and the octave data OCT, and this data is further offset in accordance with the value of the register j1, so as to generate the tone pitch data TH. It supplies the tone pitch data TH and the tone color data TC to the tone generator 9, then it commands a key-on. The tone generator 9 then generates tone signal in accordance with the specified tone pitch and the tone color, and supplies the data to the sound system 10. The tone signal is outputted from the speaker SP as a tone. It then proceeds to step Sc9.

In step Sc9, it sets [1] in the register NON to set it to the tone generation condition, and it proceeds to step Sc10. In step Sc10, it sets the values of the registers ED0, ED1 which have been determined in step Sb1 in the elbow routine to the registers RD0, RD1, and stores these values therein as reference data for the left and right elbow bending angles at the time of key-on event, and it proceeds to step Sc 17, shown in FIG. 9.

In step Sc17, it generates respective tone effects instruction data (refer to FIG. 3) on the basis of the corresponding pressure data set in the registers SRP5 to SRP7, and supplies them to the tone generator 9. For example, if a pressure sensor SR6 is pressed, the tone generator 9 adds vibrato to the tone signal generated, and then supplied the signal to the sound system 10. The tone signal with the tone effects added is outputted from the sound system 10. At this point, it completes the grip routine, and returns again to the main routine.

Upon returning to the main routine (refer to FIG. 7), it repeats the above described steps Sa2, Sa3 until the clock count value reaches a specific value. When the clock count reaches the specific value, the decision in step Sa3 becomes [YES], and it proceeds to step Sa4 again, and calls up the elbow routine (refer to FIG. 8).

(c) Operations during the Note-on (tone generation) Period

When the elbow routine is started up, it first performs processing in the steps Sb1, Sb2 (refer to FIG. 8), and then it proceeds to step Sb3. In step Sb3, it again checks whether the tone is being generated by the note-on flag stored in the register NON. In this case, the register NON has been set to [1] in the previously described step Sc9, the decision in this case is [YES], and it proceeds to step Sb4.

In step Sb4, it sets [0] in the register i. This register i is provided with a flag to indicate which of the two elbows, left or right elbow, is in-process. In this case, since [0] is set in the register i, the right elbow is indicated. In other words, the subsequent steps Sb5 to Sb10 are processed in accordance with the bending angle of the right elbow.

Next, it proceeds to step Sb5, and it checks the value of the register RD0 which stores the data which correspond to right elbow bending angle, i.e, it checks whether the value in the register RD0 is [0] (the elbow being outstretched straight), or [127] (the elbow being bent maximally) or some other value. Depending on the decision, the program takes three different paths, and performs one of the three processing methods (a) to (c) described below. It then sets this value in the register BUF0, and the value of this register BUF0 is transformed into a parameter to control the tone being generated.

(a) When the register value RD0 is [0]

Figures 6A, 6B, 6C:
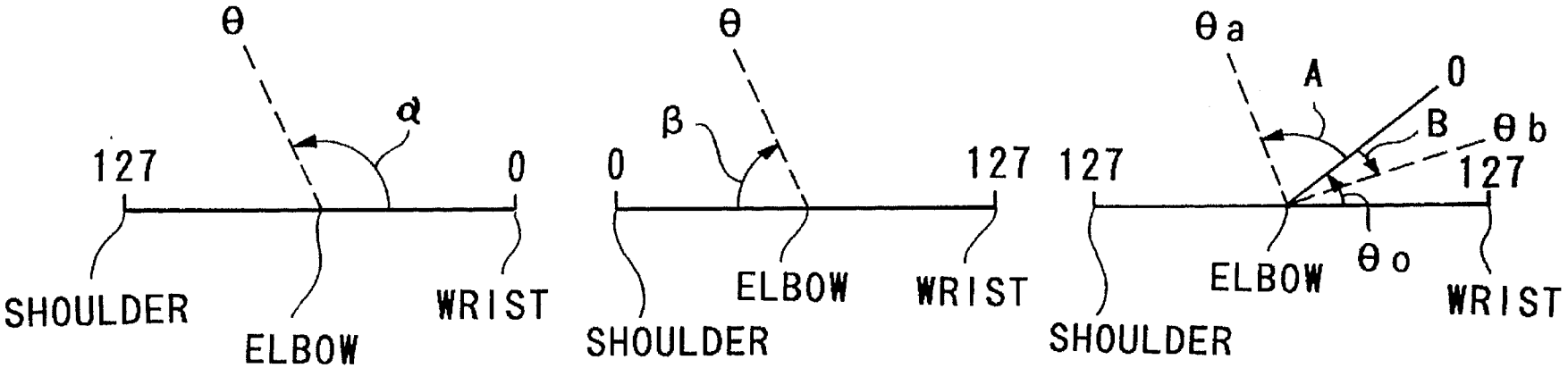
FIG. 6(A) when the elbow is outstretched straight.
FIG. 6(B) when the elbow is completely bent.
FIG. 6(C) when the elbow is bent at a certain angle.

This case corresponds to a state in which the elbow is outstretched straight at the time of key-on event, as shown in FIG. 6(*a*), the value θ, which represents the present right elbow bending angle value of the register ED0, becomes equal to the value of the angle change α from the time of the key-on event. Therefore, in step Sb6, it sets the value of the register ED0 in the register BUF0. If the right elbow is straight at the time of key-on, and if the elbow becomes bent maximally after the key-on event, the maximum value [127] is set in the register BUF0.

(b) When the register value is [127]

This case corresponds to a state in which the right elbow is maximally bent at the time of key-on event, as shown in FIG. 6(*b*), the value of θ representing the present bending angle of the right elbow assumes a complementary relationship to the absolute value of the angle change β from the time of the key-on event. Therefore, in step Sb7, an absolute value β, the angle change obtained by subtracting the value θ in the register ED0 from the maximum value [127], is set in the register BUF0. In this case, when the elbow is outstretched straight after the key-on event, the maximum value [127] is set in the register BUF0.

(c) When the Register Value is a Value other than [0] or [127]

This case corresponds to a state in which the elbow is bent at an angle $\theta_0$ at the time of key-on event, and as shown in FIG. 6(*c*), the present right elbow bending angle could be either of the two cases: a case in which the present angle is larger than ($\theta_a > \theta_0$) and a case in which the present angle is smaller than $\theta_0$ ($\theta_b < \theta_0$). Thus, first in step Sb8, it checks whether the value of θ in the register ED0 is larger than that of $\theta_0$ in the register RD0, and depending on the result, the path becomes separate.

First, when the value $\theta_a$ in the register ED0 is larger than the value $\theta_0$, the decision result in step Sb8 becomes [YES], and it proceeds to step Sb10. In step Sb10, the value $\theta_0$ in the register RD0 is subtracted from the value $\theta_a$ in the register ED0 to calculate the absolute angle change A from the time of key-on event. Next, this decremented result is subjected to scaling processing so as to make the maximum value [127] correspond with the elbow being maximally bent. More specifically, the value calculated by the following expression (1) is set in the register BUF0.

$$(\theta_a-\theta_0)\times 127/(127-\theta_0) \quad (1)$$

On the other hand, when the value $\theta_b$ in the register ED0 is smaller than the value $\theta_0$, the decision result in step Sb8 becomes [NO], and it proceeds to step Sb9. In step Sb9, the value $\theta_b$ in the register ED0 is subtracted from the value $\theta_0$ in the register RD0 to calculate the absolute angle change B from the time of the key-on event. Next, this decremented result is subjected to scaling processing so as to make the maximum value [127] to correspond with the elbow being maximally bent. More specifically, the value calculated by the following expression (2) is set in the register BUFO.

$$(\theta_0-\theta_b)\times 127/\theta_0 \quad (2)$$

When one of the three processing steps, (a) to (c), presented above is performed, it then proceeds to step Sb11. In step Sb11, it checks whether the steps Sb5 to Sb 10 have been carried out for the left elbow, i.e. there is [1] in the register i. If [1] is not set in the register i, the decision becomes [NO], and it proceeds to step Sb12, and sets [1] in the register i, it returns to step Sb5. It carries out the steps Sb5 to Sb10 in accordance with the state of bending of the left elbow.

When it proceeds to step Sb11, the decision in this step becomes [YES], and it proceeds to step Sb13. In step Sb13, the values in the registers BUF0 and BUF1 are converted to tonal control parameters EP0, EP1, and it forwards the results to the tone generator 9.

Here, the tonal control parameters EP0, EP1 can be any of the following parameters such as: Q factors or cut-off frequency limits of a filter; the speed and the factor of amplitude (or pitch) modulation of vibrato; volume and panning; the degree of frequency modulation (FM) and FM feedback value which affect the tone color. It is also possible to dispose the switches to correspond with the various control parameters on the switch group 7, and to select the control parameters to be controlled with the left and right elbows.

When the elbow routine is completed as described above, it returns again to the main routine (refer to FIG. 7), and again proceed to step Sa5, and calls up the grip routine.

(D) Operations at the time of Key-off Event Generation

When the grip routine is started, it first performs the steps Sc1 and Sc2, and then proceeds to step Sc3. In step Sc3, it checks whether there is a new key-on event. If there is no new key-on event, the decision is [NO], and it proceeds to step Sc11.

In step Sc11, it checks whether there is a key-off event in any of the pressure sensors SR1 to SR4. If there is a key-off event in any of the pressure sensors SR1 to SR4, the decision is [YES], and it proceeds to step Sc12.

In step Sc12, it sets an assigned number for the pressure sensor having a key-off event to the register j2, and proceeds to step Sc13. In step Sc13, it checks whether the pressure sensor having the key-off event was [ON] until the generation of the key-off event, i.e whether the values set in the register j1 and j2 are equal. If the values in the registers j1 and j2 are equal, the decision is [YES], and it proceeds to step Sc14. Regarding the case of the pressure sensor, having the key-off event, which was not [ON] before the key-off event, this will be described later under the heading of (E) concerning operations at the time of after touch.

In step Sc14, it commands a key-off to the tone generator 9. Accordingly, tone signal generation is stopped, and the tone generation is stopped. Proceeding onto step Sc15, it sets [0] in the register NON indicating a no-tone-generation. Proceeding to step Sc17, it again performs effects instruction steps, thereby completing the grip routine, and it returns again to the main routine. Subsequently, it calls up the elbow routine and the grip routine at regular intervals, and repeats the above described processing steps.

(E) Operations at the time of After Touch

The case of selecting the priorities of key-on events after a key has already been touched will now be discussed. If a key-on event is generated in a pressure sensor SR1, and during the tone generation process for this tone, if another key-on event is generated on a pressure sensor SR2, the technique of LIFO (last-in first-out) is used, thereby making the pressure sensor SR2 generate a key-on event, and the key-on event on the pressure sensor SR1 is automatically cancelled at the time of the generation of the key-on event on the pressure sensor SR2. Therefore, even if the finger pressure from the pressure sensor SR1 is released thus generating a key-off event, key-off processing is not performed.

In the above presented case, in step Sc13 in the grip routine (refer to FIGS. 9 and 10), the values set in the registers j1 and j2 become unequal, and the decision is [NO] in this case. Without performing the key-off processing, and it proceeds to step Sc16. In step Sc16, it forwards the pressure data from the pressure sensor SR2 which is presently in the key-on as after touch data to the tone generator 9, resulting in the generation of the tone in accordance with the after touch data. It then proceeds to step Sc17, and henceforth repeats the above described steps.

As presented above, in this embodiment, the note name is specified in accordance with the left and right elbow bending angle which existed at the time of key-on event generation. The generated tone pitch is determined by this note name instruction in combination with the octave instruction made by the grip type switch 2L, and the derivative tone instruction (at the time of key-on event) made by the grip type switch 2R. Subsequently, the sustained tone is controlled by the performer changing the left and right elbow bending angles. Accordingly, the apparatus enables to incorporate various tonal effects to the tone being generated in accordance with the performer body movement.

Figure 11:
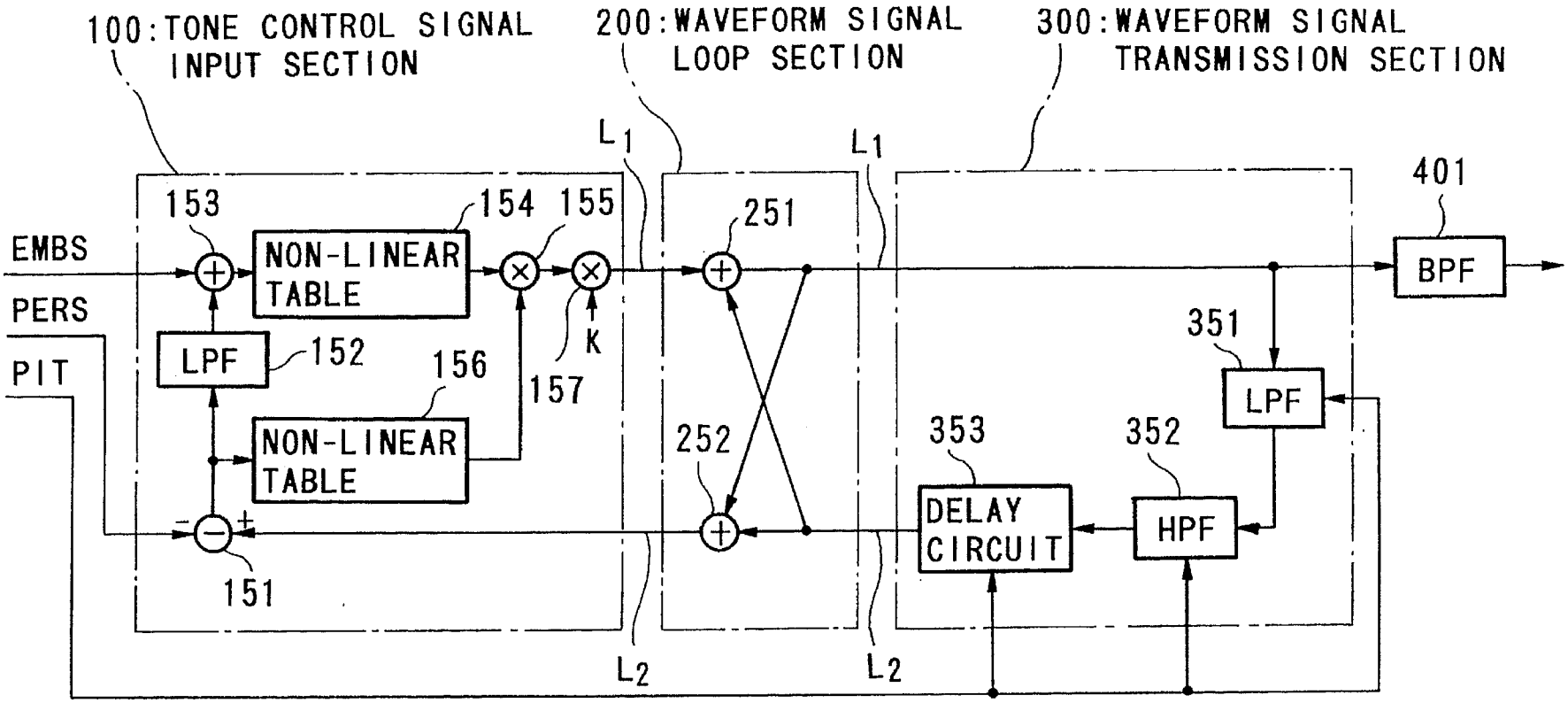
FIG. 11 is a block diagram showing a circuit configuration of a tone generator for simulating an wind instrument.
Figure 12:
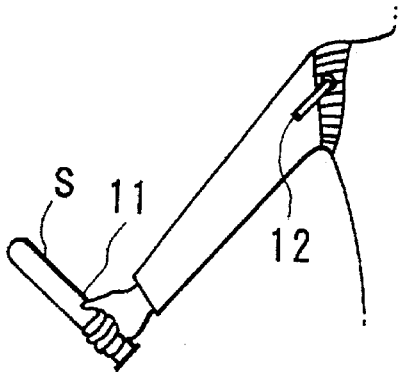
FIG. 12 shows the external configuration of an example of the conventional control apparatus for controlling the tone pitch in accordance with the degree of raising of the arm.

Further, other embodiment includes, for example, a method of supplying the output of the elbow sensors 1R, 1L to a tone generator simulating a wind instrument as shown in FIG. 11. In this figure, the reference numeral 100 refers to a tone control signal input section (shortened to control section 100). The control section 100 registers a pressure signal EMBS representing the biting pressure when the performer holds the mouth piece and another pressure signal PRES representing the blowing pressure when the performer blows into the pipe body of a wind instrument. The actions of the mouth piece and the reed are thus simulated by these signals EMBS and PRES.

The numeral 200 refers to the waveform looping section, and serves the function of repeatedly circulating the driving signal generated in the tone generator.

The numeral 300 is a waveform signal transmission section which simulates the transmission characteristics of the resonance tube of a wind instrument. The section 300 corresponds to the body length and simulates the propagation delay of the air pressure waves within the resonance tube in accordance with the tone pitch control signal PIT.

The techniques employed in the previous embodiment can also be applied to the simulating tone generator in this embodiment, for example, specifying the note name by the output signals from the elbow sensors 1R, 1L at the start of the tone generation process, and specifying the octaves and the derivative tones by the grip type switches 2R, 2L. The tone pitch data TH thus obtained can be supplied, as control data PIT to low-pass filter LPF351, high-pass filter 352 and delay circuit 353. On the other hand, if the tone generation process is in the sustaining period, in other words, a tone is being generated, a tonal control parameter EP0 outputted from the right elbow sensor 1R can be supplied to the tone control signal input section 100 as a control signal PRES representing the blowing pressure; and a tonal control parameter EP1 outputted from the left elbow sensor 1L can be supplied as a control signal EMBS, to the tone control signal input section 100.

Further, the approach need not be restricted to the wind instrument simulator, it can be adapted to string instruments such as a violin, and for example, the right elbow control parameter EP0 may represent the bow pressure, and the left elbow control parameter EP1 may represent the bow speed for the tone being generated.

Further, the parameters for controlling the input/output characteristics of the non-linear functions in the non-linear tables 154, 156 shown in FIG. 11 can also be controlled by the tone parameter control devices EP0, EP1. This approach can, of course, be applied effectively to the string instrument tone simulator.

In addition to those approaches already mentioned, it is possible to utilize the tone parameters control devices EP0, EP1 for controlling: the filter factors in various digital filters 152, 351, 352 disposed in the tone simulators; as well as the fluctuation components which are added as noise to the control signals EMBS, PRES.

Further, in the embodiments presented, the tone pitch is controlled at the start of the tone generation process, but it is also possible to control the tone pitch through: initial touch value; shift in the attack pitch; tone color types (tone color switching according to bending angle of left, right elbows); tone trending values representing moods; attack rate or level value in the envelope generator; gating time (sustaining period).

What is claimed is:

1. A musical tone controlling apparatus comprising:

(a) tone generation instruction means for outputting a tone generation start signal in accordance with a playing action of a performer;

(b) detection means for detecting a movement or a state of said performer's body other than said playing action, and generating a detection signal in accordance with the detected result;

(c) tone parameter generation means for generating a first tonal parameter in accordance with said detection signal when said tone generation start signal is received and for generating a second tonal parameter in accordance with said detection signal after said tone generation start signal has been received; and (d) tone signal forming means, for forming a musical tone signal responsive to said tone generation start signal, and for controlling the musical tone signal formation in accordance with said first tonal parameter and said second tonal parameter.

2. A musical tone controlling apparatus as claimed in claim 1, wherein said first tonal parameter represents a tone pitch of said musical tone to be generated.

3. A musical tone controlling apparatus as claimed in claim 1, wherein said second tonal parameter represents at least one tonal parameter selected from among a tone color, a tone volume and a tone effect of said musical tone to be generated, said second tonal parameter being controlled on the basis of the value of said first tonal parameter.

4. A musical tone controlling apparatus as claimed in claim 1, further including signal holding means for holding said detection signal being generated by said detection means when said tone generation start signal is received.

5. A musical tone controlling apparatus as claimed in claim 1, wherein said second tonal parameter is a driving signal for a tone generator for simulating an acoustic musical instrument.

6. A musical tone controlling apparatus as claimed in claim 1, wherein said second tonal parameter comprises a difference of said tone generation start signal and said first tonal parameter.

7. A musical tone controlling apparatus according claim 1 wherein said second tonal parameter is scaled in accordance with a value of said first tonal parameter.

* * * * *